US005129247A

United States Patent [19]

Johnson

[11] Patent Number: 5,129,247

[45] Date of Patent: Jul. 14, 1992

[54] METHOD FOR MAKING AN IRREGULARLY SHAPED DRAWN TUBE

[75] Inventor: Bruce R. Johnson, Muskegon, Mich.

[73] Assignee: Muskegon Automation Equipment, Inc., Muskegon, Mich.

[21] Appl. No.: 644,821

[22] Filed: Jan. 23, 1991

Related U.S. Application Data

[63] Continuation-in-part of Ser. No. 539,685, Jun. 18, 1990.

[51] Int. Cl.[5] ..... B21D 22/10

[52] U.S. Cl. ..... 72/60; 72/133; 72/369

[58] Field of Search ..... 72/60, 57, 58, 62, 61, 72/166, 133, 364; 29/421.1

[56] References Cited

U.S. PATENT DOCUMENTS

| | | | |
|---|---|---|---|
| 203,842 | 5/1878 | Leland | 72/369 |
| 506,157 | 10/1893 | Clarke | 72/166 |
| 1,947,611 | 2/1934 | Miotke | 72/58 |
| 1,996,838 | 4/1935 | Snell | 72/166 |
| 2,183,702 | 12/1939 | Wendel | 72/166 |
| 2,335,342 | 11/1943 | Kvarnstrom | 72/166 |
| 2,450,580 | 10/1948 | Conzelman, Jr. | 72/166 |
| 2,701,002 | 2/1955 | Arbogast | 72/166 |
| 2,837,810 | 6/1958 | Ekholm | 72/62 |
| 2,844,185 | 7/1958 | Enghauser | 72/133 |
| 2,918,102 | 12/1959 | Kelin | 72/166 |
| 3,243,873 | 4/1966 | Steel | 29/157 |
| 3,328,996 | 7/1967 | Pin et al. | 72/301 |
| 3,354,681 | 11/1967 | Lombard | 72/166 |
| 3,453,857 | 7/1969 | Reckard | 72/357 |
| 3,625,040 | 12/1971 | DeGain | 72/59 |
| 4,157,024 | 6/1979 | Kahlow et al. | 72/168 |

FOREIGN PATENT DOCUMENTS

| | | | |
|---|---|---|---|
| 0215225 | 12/1983 | Japan | 72/367 |
| 0607619 | 5/1978 | U.S.S.R. | 72/133 |
| 0795609 | 1/1981 | U.S.S.R. | 72/369 |
| 1013021 | 4/1983 | U.S.S.R. | 72/62 |

*Primary Examiner*—Lowell A. Larson
*Assistant Examiner*—Michael J. McKeon
*Attorney, Agent, or Firm*—Dykema Gossett

[57] ABSTRACT

Method for forming a tubular metal member of a shape and length having an opened end and a closed end into an element which is formed of a different shape and length by forcing and thereby flowing the metal of the tubular member from one mold cavity to another. The method utilizes a form mold having an entrance cavity of a shape and length generally corresponding to the tubular member and in which the entire tubular member is initially located and an exit cavity of a different shape and length in which the flowing metal of the tubular metal member is forced to form the element having the shape and length of the exit cavity. The form mold has an entrance opening in a side wall thereof which is connected to the entrance cavity. The tubular metal is initially located entirely within the entrance cavity of the form mold, with the closed end thereof located adjacent the exit cavity and the opened end of the tubular metal member being located at the entrance opening to the entrance cavity. Means are provided for simultaneously applying a mechanical force and a hydraulic force in a first direction to the tubular metal member to thereby flow the metal of the tubular member from the entrance cavity into the exit cavity to form the formed element. The form mold has a passage leading from the exit cavity to a source of hydraulic fluid which reacts against the closed end of the tubular metal member in a second direction in opposition to the hydraulic and mechanical forces applied in the first direction to the tubular metal member in order to control the speed of the formation of the formed element. Further, a method is disclosed for initially setting up the mold to ensure that the tube will be formed as quickly as possible and yet will have no bends.

2 Claims, 2 Drawing Sheets

METHOD FOR MAKING AN IRREGULARLY SHAPED DRAWN TUBE

This application is a continuation-in-part of U.S. Pat. application Ser. No. 07/539,685 which was invented by the inventor of the present application and filed on Jun. 18, 1990.

FIELD OF THE INVENTION

The present invention relates to an apparatus including a form mold and to a cold forming process or method for making in the form mold an irregularly shaped drawn tube which is subjected to hydraulic and mechanical forces to cold flow the metal through the cavities of the form mold. Such apparatus and method are useful to form aluminum, steel or brass drawn tubes of various lengths, diameters and wall thicknesses.

BACKGROUND OF THE INVENTION

Various methods and apparatuses are disclosed in the prior art for forming metal tubes. For example, U.S. Pat. No. 2,450,580 entitled "TUBE BENDER" issued on Oct. 5, 1948 to John E. Conzelman, Jr. This patent discloses a tube bender which uses hydraulic pressure in combination with a ram to force a tube blank, having the majority of its length outside the die through the curved die. This patent teaches the use of hydraulic pressure alone in order to form curved tubes in certain instances. Where necessary, an additional force is applied by a mechanically acting ram. Pressure control inside the closed tube is allowed by an exhaust means. Additionally, interior pressure may be supplemented by the use of non-compressible balls, each having a diameter slightly less than that of the interior diameter of the tube blank.

U.S. Pat. No. 2,183,702 entitled "DIE ASSEMBLY FOR FORMING HOLLOW METAL ARTICLES" on Dec. 19, 1939 issued to Frans W. Wendel. It teaches the use of tube blanks filled with oil and forced into a curved die by means of plungers until the blanks at least initially form arcuate shapes. Wendel indicates that it may quite often be necessary to form a shape in two or three steps using this method to produce a tube with a blunt end.

U.S. Pat. No. 3,625,040 entitled "METHOD AND APPARATUS FOR FORMING ARTICLES FROM A TUBULAR BLANK", issued on Dec. 7, 1971 to William J. DeGain. This patent teaches the use of hydrostatic metal forming wherein the pressure developed from inside the tube blank causes a tube to deform within the contours of a die assembly. The whole die assembly is submerged preferably in water, although other hydraulic fluids are cited, and hydraulic pressure is applied to the interior of the tube blank sufficient to cause deformation. Both ends of an open tube are plugged, although passageways to the hydraulic pressure source are found within the plug. The tube blank does not force its way through the die, rather it is caused to adopt the contour shape of the die that is being impressed against it.

U.S. Pat. No. 203,842 entitled "METHOD OF BENDING PLUMBERS' TRAPS" issued on May 21, 1878 to Edwin A. Leland It discloses the use of a fluid filled lead pipe that may be bent into arcuate shapes without collapsing at tight radii. The use of hydraulic pressure is disclosed in Leland for the purpose of assisting in the deformation of the lead piping. According to the patent, pressurizing a tube with fluid while in a die is known, such that Leland is distinct in not requiring a die. The primary reliance in this patent is placed on the flexibility and ductility of the subject metal.

U.S. Pat. No. 3,328,996 entitled "DEVICE AND METHOD FOR MANUFACTURING ELBOW FITTINGS FROM STRAIGHT TUBING", issued on Jul. 4, 1967 to P. H. Pin, et al. The patent discloses the use of a pressure ram that supplies a constant force on a substantially incompressible medium placed inside the tube blank. The tube blank is then inserted into a die where the top half is subject to displacement laterally, and is coordinated with a cavity in the die which allows formation of the tube into a curved form with nominal loss of internal dimensional integrity. This patent describes the use of various medium that has been used in the prior art, such as sand, water, oil, rubber, etc.

U.S. Pat. No. 2,918,201 issued on Dec. 22, 1959 to A. A. Klein and is entitled "APPARATUS FOR BENDING TUBE BLANKS". This patent teaches the use of a ram with associated die with allowances for a controlled pressure condition. The ram is assisted by the use of an incompressible medium that tends to exhibit fluid characteristics. This medium may be of rubber or synthetic plastics. The pressure control occurs through the exit port of the die. The patent also discloses the use of a ram to cause the tube blank to proceed through the die.

U.S. Pat. No. 2,837,810 issued on Jun. 10, 1958 to Carl R. Ekholm and is entitled "METHOD OF PRODUCING FITTINGS". This patent discloses the use of a tube blank where both ends are sealed, but where one end is allowed to receive a port for hydraulic application. A blank thus inserted into a die form can be pressurized to the extent necessary to adopt the form of the die. Deformation of the tube blank along those portions of the die where clearance exists is allowed to take place under high hydraulic pressure. The tube blank is not forced through the die but rather reacts to the pressure applied internally.

U.S. Pat. No. 3,243,873 issued on Apr. 5, 1966 to Homer J. Steel and is entitled "TUBE BENDING". This patent utilizes an axial roller device that engages suitably shaped "free mandrels" that are placed into the interior of the tube blank. As the blank is forced through the access portion, the free mandrels are compatibly guided by the axial roller, causing an incremental bending action near the end of the tube.

Therefore, it is an object of the present invention to provide an improved method and apparatus for making an irregularly shaped drawn tube or element.

Another object of the present invention is to provide a method and apparatus which are efficient to operate and are capable of producing an irregularly shaped drawn tubular element in a short period of time, as an example, 5 to 10 seconds.

Still another object of the present invention is to form a tube closed at one end into almost any shape by forcing the tube through a form mold by use of hydraulic and mechanical pressures and by controlling the speed of the formation of the displaced metal by the use of hydraulic pressure from the opposite end of the tube.

It is further an object of the present invention to discloses a method of initially setting up an apparatus for making irregularly shaped drawn tube, wherein the operating pressures are controlled to ensure that the irregularly shaped tube will not have bends at any curved portions in the shaped tube.

SUMMARY OF THE INVENTION

In accordance with the present invention, a tube with one closed end and one opened end can be formed into almost any shape and length by forcing the tube through a form die by use of hydraulic and mechanical pressures and by controlling the speed of the form by the use of hydraulic pressure from the opposite end of the tube. The apparatus includes a form mold or die having an upper part and a lower part. The die components or parts are made from air hardened tool steel, either A2 or D2. The two-part die or mold is provided with hand polished surfaces having a 10 micro finish or better down to a 2 or mirror micro finish. The form mold is provided with an entrance cavity and an exit cavity. The entrance cavity has a configuration, a length and shape, corresponding to the configuration of the drawn tube which is placed in the form mold when opened. The exit cavity of the form mold has an irregularly shaped cavity of a certain configuration and length which corresponds to the element or tube to be formed in the mold utilizing the hydraulic and mechanical pressures to be described hereinafter.

The invention further contemplates a sequence of operations including taking coil stock which is fed into a blank and drawn die to produce a drawn cup. The cup is then fed into a re-draw die to produce a deeper, smaller diameter cup. The re-drawn cup is then fed into ironing tooling to produce the proper wall thickness and length. The ironed tube may have any wall thickness and be made from a metal such as aluminum, steel or brass. The drawn tube may have a length, as an example from 18 inches to 36 inches, a diameter from about ½ inch to 3 inches and a wall thickness from about 1/16 inch to ⅛ inch. The bottom of the drawn tube at the closed end thereof has a wall thickness of at least ¼ inch.

The formed or drawn tube having a closed bottom is then inserted into the form mold's entrance cavity which has a length and configuration equal to the length and shape of the tube. The mold closes and pressure is applied by the press to the mold to hold it closed.

The invention further contemplates means for simultaneously applying a mechanical force and a hydraulic force in a first direction to the tubular metal member or tube to thereby flow the metal of the tubular member from the entrance cavity into the exit cavity to form the formed element. Such means includes the use of a piston and rod assembly, with the piston having a first portion forming a plug which extends through the entrance opening of the form mold into the opened end of the tubular metal member to provide a seal therebetween. A second portion of the piston, which is larger than the first portion, is of a size to abut the open end surface of the tubular member and to fit within the entrance cavity of the mold and thereby mechanically force and flow the metal of the tubular member through the entrance cavity into the exit cavity when the piston and rod assembly are moved into the tube.

The invention further contemplates that the piston and rod assembly is provided with a passage extending therethrough for delivering hydraulic fluid under pressure from an external source to the interior of the tubular member between the closed end thereof and the piston.

The invention further contemplates the placing of the form mold in a hydraulic press and the operation of the press so as to apply, as an example, 30,000 pounds thereto to hold the die parts together during the cold metal forming process. Upon the closing of the mold, hydraulic pressure is also applied to the open end of the tube. The piston or plug is made from tool steel and is designed to keep the hydraulic pressure in the cylinder. The interior of the tube is pressurized with hydraulic fluid from 1,000–2,000 pounds per square inch. The pressure of the fluid allows the tube to be formed in the exit cavity of the form mold without the collapsing of the metal while simultaneously causing the tube to be forced through the irregularly shaped configuration of the exit cavity. Plastic deformation of the metal takes place in this process resulting in a more uniform construction.

The invention further contemplates that hydraulic pressure is applied in opposition to the closed end of the tube in order to control the rate at which the tube is formed through the formed die or mold. Control of the rate of metal flow allows for more stability in the plastic deformation thereby increasing the degree of curvature beyond that which would normally be expected.

In order to accomplish the foregoing, the invention contemplates the utilization of a passage connecting the exit cavity of the form mold to a pressure source whereby the hydraulic pressure acts against the closed end of the tubular member. The cold forming process just described to make the irregularly shaped tubular member, element or tube takes anywhere from 5 to 10 seconds to form the tube.

The invention contemplates the forcing of the metal from the entrance cavity of the form mold to the exit cavity to assume the shape thereof. The pressure within the mold is then released and the mold is opened. The formed tube or element is lifted from the form mold and the ends of the formed tube are trimmed, if required, to suit the particular needs.

Further, in a method for initially setting up the apparatus of this invention, the pressure on the closed end of the tube is varied so as to determine the lowest pressure, and consequently the fastest shaping speed, which can be utilized without having the shaped tube have bends or wrinkles at any curved portions.

In a specific method according to the present invention, a flow restrictor is placed on a line that communicates with the closed end of the tube to be shaped. The restrictor is initially set at a first position slightly removed from a fully closed position. The tube is then shaped by applying a pressure to the opposite end of the tube, which causes the tube to move through the mold. Fluid passes through the restrictor and applies a back pressure to the tube ensuring that it is not shaped too quickly, which could result in bends at any curved portions.

The tube shaped at this first opening of the restrictor is studied to determine whether there are any bends at the curved portions. If there are no bends at the curved portion for that first opening, the restrictor is opened to the next setting and the tube is again shaped. This process continues until a tube is shaped which does have bends at the curved position. The restrictor is then reset to the next most closed position. In this way, it is ensured that the restrictor is as open as possible, while still maintaining the desired result of the shaped tube not having bends at the curved portion. When the tubes are shaped in mass production, the time saving provided by this method can prove valuable.

Thus, the present invention provides an improved method and apparatus for making an irregularly shaped element.

DESCRIPTION OF THE PREFERRED EMBODIMENTS

Figure 1:
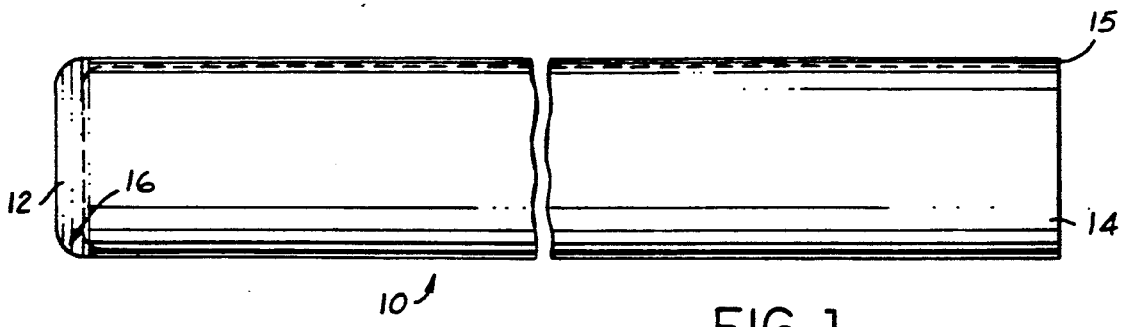
FIG. 1 is a elevational view of a tubular metal member or ironed tube, with a part broken away, having a closed end and an opened end.
Figure 2:
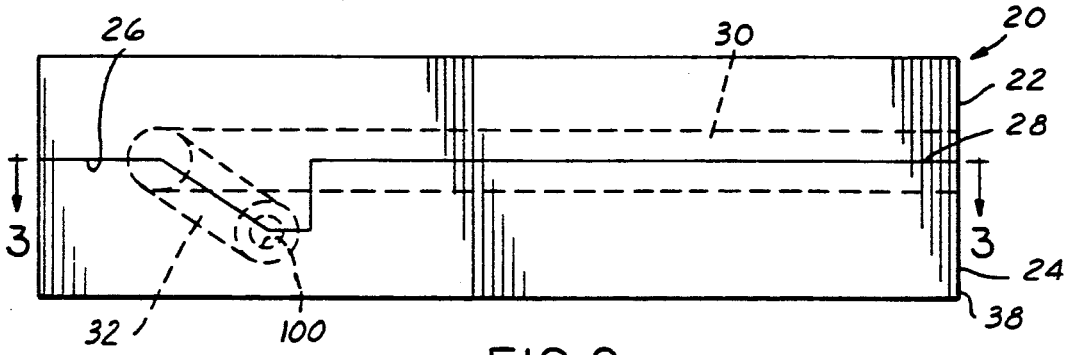
FIG. 2 is a front elevational view of a form mold in which the tubular metal member of FIG. 1 is inserted.
Figure 3:
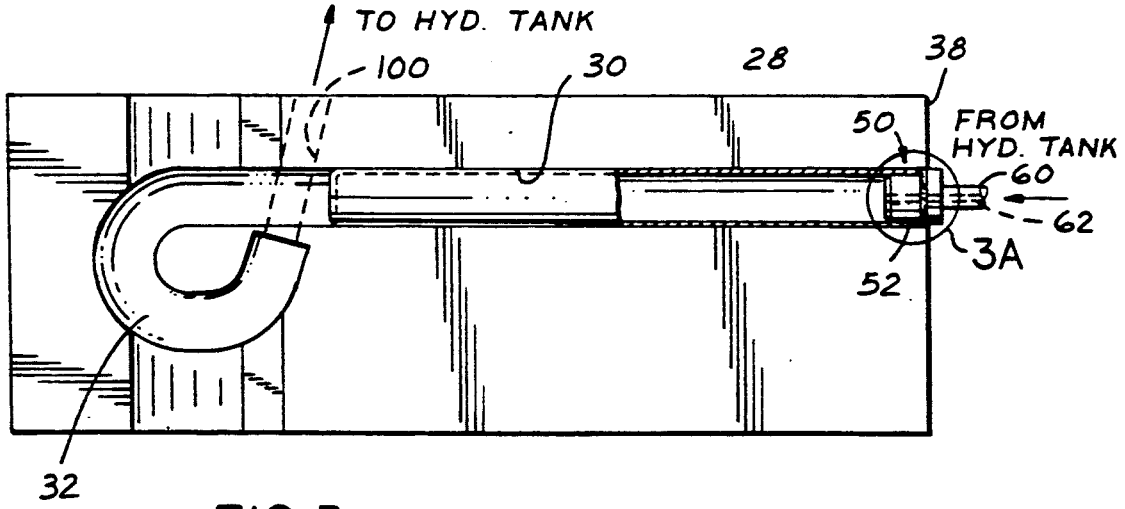
FIG. 3 is a sectional view through the form mold taken along the line 3—3 of FIG. 2 and showing the tubular metal member in the entrance cavity of the form mold.
Figure 3A:
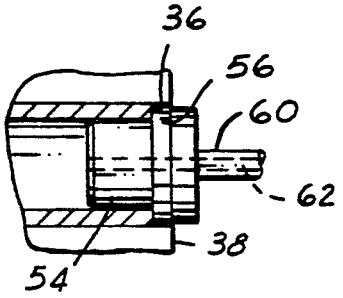
FIG. 3A is a fragmentary enlarged view of a part of FIG. 3 showing the piston and rod assembly of the apparatus in sealing engagement with the opened end of the tubular metal member located in the entrance cavity of the form mold.

Referring now to the drawings, the invention contemplates the initial formation of a tubular metal member 10 having a length as an example from 18 inches to 36 inches, an outside diameter of from ½ inch to 3 inches and a wall thickness from about 1/16 inch to ⅝ inch. The tubular member 10 is formed from coil stock which is fed into a blank and draw die to produce a drawn cup as is known in the art. The drawn cup is then fed into a re-draw die to produce a deeper, smaller diameter cup as is also known in the art. The re-drawn cup is then fed into ironing tooling to produce the proper wall thickness and the proper length of the tubular metal member, of the form shown in FIG. 1. It should be observed that the tubular metal 10 has a closed end 12 and an opened end 14. The closed end 12 has a wall thickness which is substantially greater than the wall thickness of the tube 10 and should be at least ¼ inch thick. In addition, the closed end 12 has a curvature 16 formed on a radius of from ⅜ inch to ½ inch minimum. The formation of the closed end of the tube 10 is important so that the metal may flow within the closed form mold when subjected to the hydraulic and mechanical forced to be described.

The apparatus 20 for practicing the invention includes a form die having an upper part 22 and a lower part 24. The two part die or mold is made from air hardening tool steel either A2 or D2 as is known in the art. The mold part mating surfaces 26 and 28 are hand polished and are provided with a 10 micro-finish or even to a 2 micro or mirror finish as is known in the art.

The form mold 20 has a entrance cavity 30 and an exit cavity 32. An entrance opening 36 is provided in the sidewall or end surface 38 of the form mold 20. The entrance cavity 30 has a length substantially greater than the length of the exit cavity 32. The entrance cavity 30 has a length equal to the length of the tubular member 10 and further has a diameter generally equal to the outside diameter of the tubular member 10. In practicing the invention, the tubular member 10 is placed within the corresponding portion of the cavity 30 provided in the bottom or lower die part 24. Thereafter, the upper mold or die part 22 is closed over the bottom die part or mold 24 so as to enclose the entire length of the tubular member 10 within the entrance cavity 30.

Figure 5:
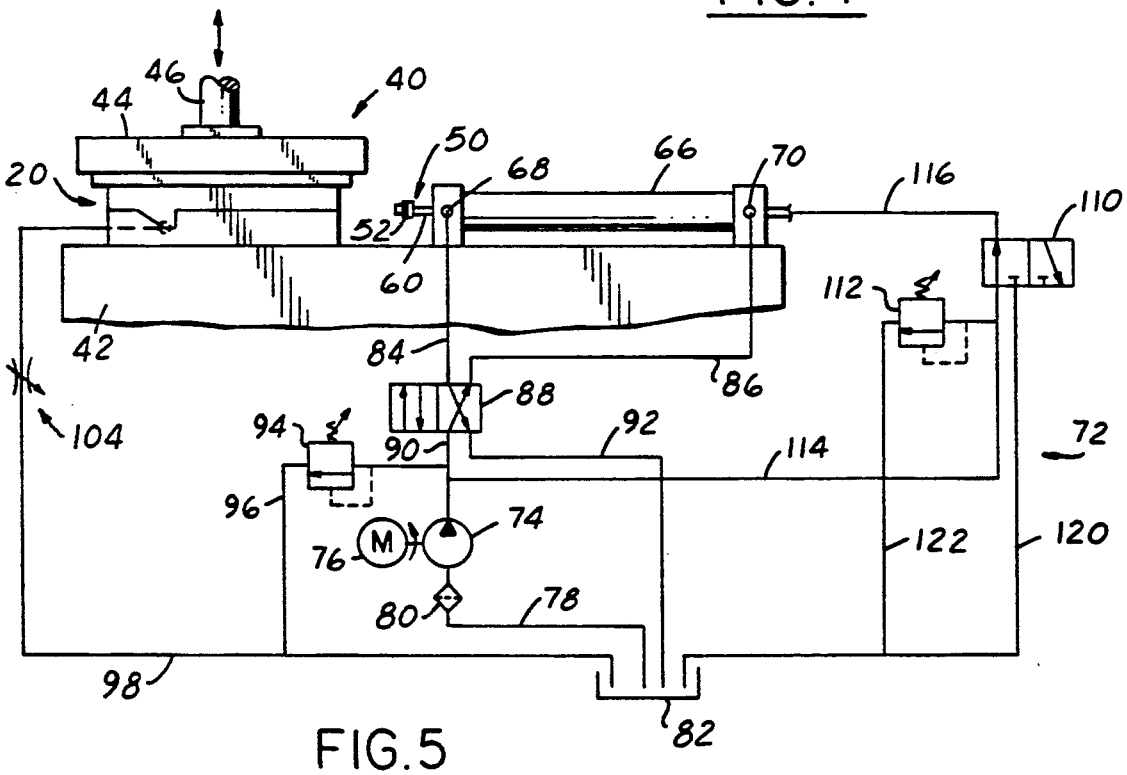
FIG. 5 is a hydraulic circuit or diagram showing the hydraulic press in which the apparatus is initially placed to hold the mold in a closed position and the hydraulic circuity utilized for practicing the present invention.

The closed mold 20 is positioned within a hydraulic press 40, FIG. 5, having a stationary or bottom platen 42 and an upper movable platen 44. The press 40 includes a hydraulic cylinder 46 which is connected to the upper movable platen 44 for applying a hydraulic force thereto, as an example 30,000 pounds.

Figure 6:
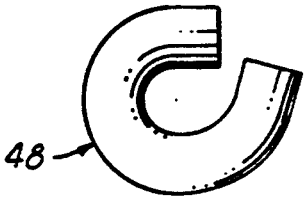
FIG. 6 is a elevational view of an irregularly shaped tubular member made according to the present invention.

In further carrying out the invention, a hydraulic and a mechanical system is provided for cold flowing the metal from the entrance cavity 30 into the exit cavity 32 to form the tubular irregular shaped element 48 as shown in FIG. 6. The system includes a piston and rod assembly 50 having a piston 52. The piston 52 has a first portion 54 forming a plug which extends through the entrance opening 36 of the form mold 20 into the open end 14 of the tubular member 10 and effectively providing a seal between the first portion 54 and the tubular member 10. The piston 52 further includes a second portion or flange 56 of generally circular configuration so as to fit within the bore of the entrance cavity 30. With such a construction the second portion or flange 56 abut the annular end wall or surface 15 of the tubular member 10.

Figure 4:
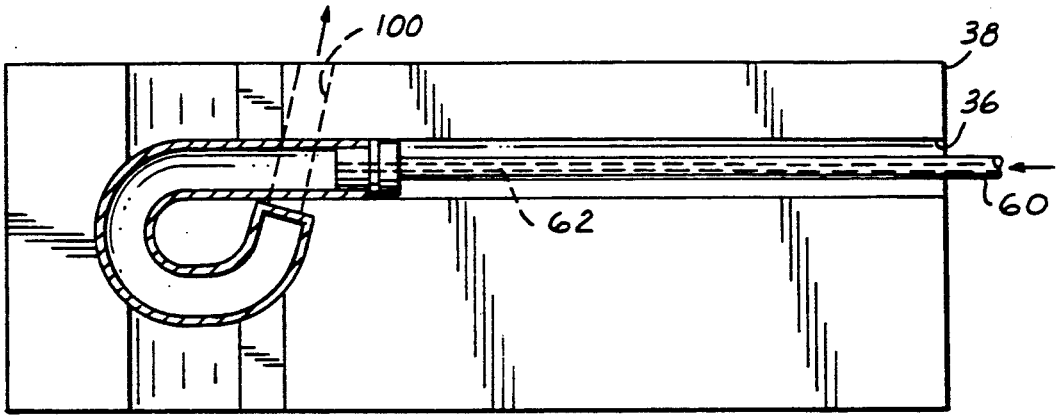
FIG. 4 is a sectional view similar to FIG. 3 and showing the piston and rod assembly of the apparatus in an extended position to thereby flow the metal from the entrance cavity to the exit cavity of the form mold.

The piston and rod assembly 50 includes a rod 60 having a centrally located passage 62 provided therein. The passage 62 extends through the rod 60 and also the piston 50 as shown in FIG. 4. The purpose of the passage 62 provided in rod 60 and piston 52 is to provide hydraulic fluid under pressure in the interior of the tubular metal member 10 where the hydraulic fluid acts against the metal of the tubular member including the closed end 12 so as to cold flow the metal in one direction from the entrance section 30 into the exit cavity 32 as is best illustrated in FIG. 4.

The piston and rod assembly 50 is connected to a hydraulic cylinder 66 having a piston, not shown, provided therein. The hydraulic cylinder has ports 68 and 70 as opposite ends thereof so as to direct hydraulic fluid into and out of the cylinder 66. The cylinder 66 is mounted on the stationary platen 42. The hydraulic cylinder 66 forms part of a hydraulic circuit 72, which includes a hydraulic pump 74 driven by a motor 76. A return line 78 having a filter 80 provided therein connects the inlet of the pump 74 with the reservior 82.

The hydraulic circuit 72 further includes cylinder lines 84 and 86 which connect the cylinder ports 68 and 70 respectively to a four-way directional control valve 88. The pump 74 is connected to the four-way directional control valve 74 by a supply conduit or passage 90. The control valve 88 is also connected to a return line 92 which leads from the four-way valve 88 to the reservoir 82. The pump supply passage or conduit 90 is provided with a pressure relief valve 94 in a return line 96 which connects pump passage 90 to conduit 98.

The exit cavity 32 of the form mold 20 is provided with a passage 100 which leads from the back of the exit cavity 32 and is connected by hydraulic line 98 to the reservoir 82. A flow control device or restriction 104 is provided in line 98. The purpose of hydraulic line 98, passage 100 and the restriction 104 is to provide hydraulic fluid to the opposite side of the closed end of the tubular member 10, so as to control the speed of the element or member to be formed. This is accomplished by the use of the hydraulic pressure or back pressure delivered via hydraulic conduit 98 and passage 100. The back pressure of the hydraulic fluid is less than the hydraulic pressure acting in the first direction within the interior of the tube 10. Restrictor 104 may be incrementally opened in order to control the pressure and flow through restrictor 104.

The hydraulic circuit 72 further includes a three-way valve 110, a pressure relief valve 112, a hydraulic supply line 114 for connecting the hydraulic pump 74 through the three-way valve 110 to hydraulic line 116 which delivers hydraulic fluid to the cylinder 66 so as to move the piston and rod assembly 50 in the first direction towards the exit cavity so as to cold flow the metal by applying hydraulic and mechanical forces to the tubular metal member 10. A return reservoir line 120 connects the three-way valve 110 to the reservoir 82. The pressure relief valve 112 is located in line or conduit 122 which is connected to the supply line 114 and the return line 120.

In a method of setting up the inventive apparatus, restrictor 104 is preferably of the sort having several incremental opened positions. That is, restrictor 104 is a variably opened restrictor which may, as an example, have 10 different settings ranging from fully closed to fully opened. The amount that restrictor 104 is opened controls the amount of fluid which can move from line 100 into line 98. This directly affects the speed with which the tube is shaped. For production purposes it is desirable to shape the tube as quickly as possible. Problems arise, however, with tubing that is formed extremely quickly since bends may occur at curved portions of the shaped tube. For this reason it is desirable to shape the tubing as quickly as possible, while ensuring that the shaped tube does not have bends at its curved portions.

In order to accomplish this goal, restrictor 104 is initially set to be fully closed. It is then moved to its first incrementally opened position and a tube is shaped within the mold. That shaped tube is studied to determine whether there are bends at any curved portion of the tube. If there are no such bends, restrictor 104 is opened to its next opened position and a second piece of tubing is formed. If that tubing does not have bends at any curved portion then restrictor 104 is opened even further. This process continues until a tube is formed which does have bends. Once bends are experienced, restrictor 104 is closed one incremental position to ensure that restrictor 104 is as open as possible while still resulting in tubes which do not have bends at their curved portion. This increases the production speed of shaping the tubes.

Once the pressure and setting of restrictor 104 is initially set, the entire length of the tubular metal member 10 is placed within the lower part 24 of the form mold 20. Thereafter, the top part 22 is placed over the lower part 24 so that the form mold entirely encloses the tubular member 20. The mold is closed and hydraulic fluid is applied to the press. The piston and rod assembly 50 is inserted into the mold with the front or first portion 54 of the piston 52 providing a plug or seal with the inside diameter of the tubular member 10. Hydraulic fluid from the pump 74 is then delivered through the directional control valve 88 and line 86 to the back end port 70 of the hydraulic cylinder 66 so as to move the piston provided therein to the left, as is viewed in FIG. 5, which is the first direction. This also mechanically applies a force to the end surface 15 of the tubular member 10 resulting in the cold flow of metal into the exit cavity 32. In addition, hydraulic fluid is applied through the piston and rod assembly 50 and the passage 62 provided therein into the interior of the tubular member 10 where the pressure of the hydraulic fluid acts upon the closed end 12 and forces same towards and into the exit cavity 32. This is accomplished by pump 74 delivering fluid through supply line 114, 3-way valve 110 and supply passage or conduit 116 into the interior of the closed tube 10. Pressure is generated in the range of 1,000–2,000 psi. It generally takes from anywhere from 5 to 10 seconds to form the tubular member 10 into, as an example, the irregularly shaped tubular element 48 shown in FIG. 6.

Once the cold flow of the metal has taken place, the pressure is relieved by reversing the directional control valve 88 and the three-way valve 110 so as to return the hydraulic fluid to the reservoir 82 via the several reservoir lines 92, 98 and 120. In addition, the pressure on the press 40 is removed and thereafter the platen 44 is raised to permit the opening of the mold 20. The formed element or member 48 is removed from the mold and the ends are trimmed, if required.

With the aforesaid construction, it is necessary to maintain the pressure within the inside diameter of the tubular part 10 located in the closed mold. The piston 52 forms a plug which seals the inside diameter of the tubular member. The plug is made from tool steel and is connected to the hydraulic cylinder via the rod 60. The pressure is maintained on the cylinder in order to prevent the plug from blowing out of the end of the tubular member. With such a process, it is necessary to maintain the entire length of the tubular member 10 within the form die or mold.

The amount of pressure to be applied within the interior of the tubular member 10 varies depending on the type of material, its thickness and length.

Figure 7:
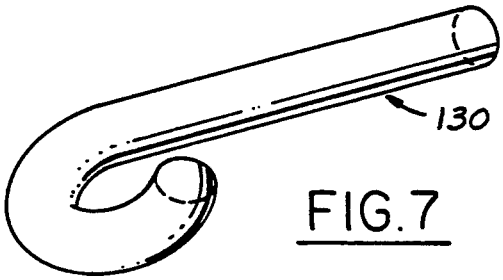
FIG. 7 is a perspective view of still another irregularly shaped member which could be made according to the present invention.

The form mold 20 may have different shapes of cavities provided therein to make different irregularly shaped elements. Another example is element 130 illustrated in FIG. 7. The present invention controls the formation of the cold flow of metal by utilizing a hydraulic back pressure in line 98 and passage 100 against the closed end of the tubular member under formation.

While a particular embodiment of this invention is shown and described herein, it will be understood, of course, that the invention is not limited thereto since many modifications may be made, particularly by those skilled in the art, in light of this disclosure. It is contemplated, therefore, by the appended claims, to cover such modifications as falls within the true spirit and scope of this invention.

What I claim is:

1. The method of forming an irregular shaped drawn tube in a mold having an entrance cavity and an exit cavity wherein a tube to be shaped is subjected to a first forward hydraulic force to flow it through the mold and a back force to resist such movement comprising the steps of:

(a) initially setting up a system by experimentally determining a hydraulic back force which is as low as possible while still providing shaped tubes which do not have bends at the shaped portions, the optimum pressure of the hydraulic back force being determined by placing a restriction on a line leading from a back pressure chamber to a sump, the restriction being opened through incremental steps to control the hydraulic force and determine the most opened position that still results in properly shaped tubes, the incremental opening of the restriction including initially placing the restriction at the first incrementally opened position most adjacent to a fully closed position and forming a tube in the mold, inspecting the tube to determine whether there are bends at the shaped portions of the tube, and opening the restriction to the next incrementally opened position and forming a subsequent tube if no such bends were formed in the first formed tube; and continuing to repeat these steps until a tube is formed having bends at the shaped portion and wherein once a tube is formed having bends, the restriction is closed back one opening to ensure that the tubes formed will have no bends;

(b) placing a drawn tube having an opened end and a closed end entirely within the entrance cavity of the formed mold; and (c) applying hydraulic force to the interior of the closed end thereof and applying a hydraulic back force of the optimum pressure to the opposite surface of the closed end of the drawn tube to flow the metal of the drawn tube from the entrance cavity to the exit cavity.

2. A method as recited in claim 1, wherein a mechanical force is also applied to the opened end of the tube to flow the metal of the drawn tube.

* * * * *